US006158423A

United States Patent [19]

Haack

[11] Patent Number: 6,158,423

[45] Date of Patent: Dec. 12, 2000

[54] CRANKCASE VENTILATION VALVE FOR AN INTERNAL COMBUSTION ENGINE

[75] Inventor: Felix Haack, Braunschweig, Germany

[73] Assignee: Volkswagen AG, Wolfsburg, Germany

[21] Appl. No.: 09/463,708

[22] PCT Filed: Jun. 12, 1998

[86] PCT No.: PCT/EP98/03548

§ 371 Date: Jan. 28, 2000

§ 102(e) Date: Jan. 28, 2000

[87] PCT Pub. No.: WO99/06679

PCT Pub. Date: Feb. 11, 1999

[30] Foreign Application Priority Data

Jul. 28, 1997 [DE] Germany ..... 197 32 367

[51] Int. Cl.[7] ..... F01M 13/02

[52] U.S. Cl. ..... 123/574

[58] Field of Search ..... 123/573, 572, 123/574

[56] References Cited

U.S. PATENT DOCUMENTS 4,167,164 9/1979 Bachmann ..... 123/573

4,580,543 4/1986 Aoki ..... 123/573

5,090,393 2/1992 Holch ..... 123/574

5,335,641 8/1994 Schnabel ..... 123/574

*Primary Examiner*—Marguerite McMahon

*Attorney, Agent, or Firm*—Cohen, Pontani, Lieberman & Pavane

[57] ABSTRACT

The invention concerns a valve for sucking up gases from an internal combustion engine crankcase (10) comprising a body (14, 16), a gas intake duct (32) connected to the crankcase inner space (12), a gas evacuating duct (28) connected to an air sucking duct of the internal combustion engine and a membrane (18) dividing the valve body (14, 16) into an inner chamber (22) on the crankcase side and an outer chamber (24) and having a suction valve attachment (34). Said membrane (18), jointly with the suction valve attachment (34), opens or closes at will the gas evacuating duct (28) according to the pressure difference between the two chambers (22, 24). The valve body (14, 16) outer chamber (24) is connected to the gas intake duct (32) and a ventilating duct (26) is provided on the crankcase side, said duct connecting the inner chamber (22) valve body (14, 16), on the crankcase side, to ambient pressure.

11 Claims, 4 Drawing Sheets

CRANKCASE VENTILATION VALVE FOR AN INTERNAL COMBUSTION ENGINE

BACKGROUND OF THE INVENTION

1. Field of the Invention

The invention relates to a crankcase ventilation valve for an internal combustion engine, with a valve housing, a gas inflow duct connected to the interior of the crankcase, a gas outflow duct connected to an air intake duct of the internal combustion engine, and a diaphragm which divides the valve housing into a crankcase-side inner chamber and an outer chamber and which has a ventilation valve disk diaphragm, together with the ventilation valve disk, selectively open or close the gas outflow duct, depending on the pressure difference between the two chambers, 2. Discussion of the Prior Art A crankcase ventilation known, for example, from DE 44 06 986 A1, EP 0 459 031 B1, DE 27 53 335 C2 and EP 0 730 086 A1 is a closed system for the recirculation of pollutants, such as, for example, oil vapor and unburnt hydrocarbons, which pass along the pistons into the crankcase interior, out of the crankcase to the engine combustion system, so that these pollutants do not escape into the environment. In this case, an intake duct of the internal combustion engine is connected to an outlet of the crankcase ventilation. Since a greater or lesser vacuum prevails in this intake duct, depending on the operating state of the internal combustion engine, precautions must be taken to ensure that this vacuum is not propagated to too great an extent into the crankcase, since air would otherwise be sucked into the crankcase from outside in an undesirable way, for example via a crankshaft seal.

For this purpose, DE 44 06 986 A1 proposes a generic crankcase ventilation valve. Here, a bore is provided in the cover of the valve housing, said bore connecting the outer chamber on a diaphragm side facing away from the crankcase to the ambient pressure. The disadvantage of this, however, is that the gas outflow duct is arranged on the crankcase side in relation to the chamber at ambient pressure and it is therefore necessary to have a complicated routing of the gas duct out of the ventilation valve through the crankcase to the air intake duct of the internal combustion engine. A modification may therefore be necessary if the internal combustion engine has different installation positions with different paths from the ventilation valve to the air intake duct of the internal combustion engine.

SUMMARY OF THE INVENTION

The object on which the present invention is based, therefore, is to provide a crankcase ventilation valve of the above-mentioned type with which the above-mentioned disadvantages being are overcome. The valve is also capable of being used universally, irrespective of the installation position of the internal combustion engine.

This object is achieved, according to the invention, by means of a crankcase ventilation valve having a valve housing, a gas inflow duct connected to an interior of the crankcase, a gas outflow duct connected to an air intake duct of the internal combustion engine, a diaphragm arranged in the housing so as to divide the valve housing into a crankcase-side inner chamber and an outer chamber, a ventilation valve disk, the diaphragm together with the ventilation valve disk being operatively arranged to selectively open and close the gas outflow duct depending on a pressure difference between the inner chamber and the outer chamber, the outer chamber of the valve housing being connected to the gas inflow duct, and a ventilation duct provided on the crankcase side so as to connect the inner crankcase-side chamber of the valve housing to ambient pressure.

For this purpose, according to the invention, there is provision for connecting the outer chamber of the valve housing to the gas inflow duct and, furthermore, for forming on the crankcase side a ventilation duct which connects the inner crankcase-side chamber of the valve housing to ambient pressure.

The advantage of this is that the gas outflow duct of the crankcase ventilation valve, together with a device for connection to the air intake duct of the internal combustion engine, is arranged on a side of the valve housing which faces away from the crankcase and can thus be universally adapted without high outlay to different installation environments and installation positions of the internal combustion engine. By contrast, the components determined essentially by the design of the crankcase of the internal combustion engine are arranged on the crankcase side, so that a single universal crankcase can be used for different installation positions of the internal combustion engine, the only requirement being to adapt a freely accessible routing of the air intake duct.

This may be achieved in a particularly simple form, for example, by the valve housing being designed in two parts, with a basic frame open on one side and with a cover in which the gas outflow duct is integrated. The basic frame is designed so as to be rotationally symmetrical and the cover is designed, at least at the point of connection to the basic frame, so as to be rotationally symmetrical. During assembly, the cover, together with the gas outflow duct, is connected to the basic frame in a position such that the gas outflow duct points in a desired direction, depending on the installation position of the internal combustion engine. Additional adapter hose connections between the ventilation valve and the air intake duct of the internal combustion engine for different installation positions of the internal combustion engine may thereby be dispensed with if appropriate, and the gas outflow duct is always oriented or orientable in the optimum direction relative to the air intake duct of the internal combustion engine.

Simple and cost-effective assembly is achieved if the basic frame and optionally, in addition, the ventilation duct are designed integrally with the crankcase.

In another embodiment of the invention, the diaphragm is prestressed counter to the pressure in the crankcase-side inner chamber by means of a spring. A predetermined pressure for the crankcase can thereby be set by means of the spring force.

A particularly simple and at the same time operationally reliable arrangement is obtained if the spring is a compression spring, in particular a helical spring, and is arranged in the outer chamber.

Expediently, the ventilation duct is formed integrally in the crankcase or in a cowl of the crankcase.

Further features, advantages and advantageous refinements of the invention may be gathered from the following illustrative description of the invention with reference to the accompanying drawings.

DETAILED DESCRIPTION OF THE PREFERRED EMBODIMENTS

Figure 1:
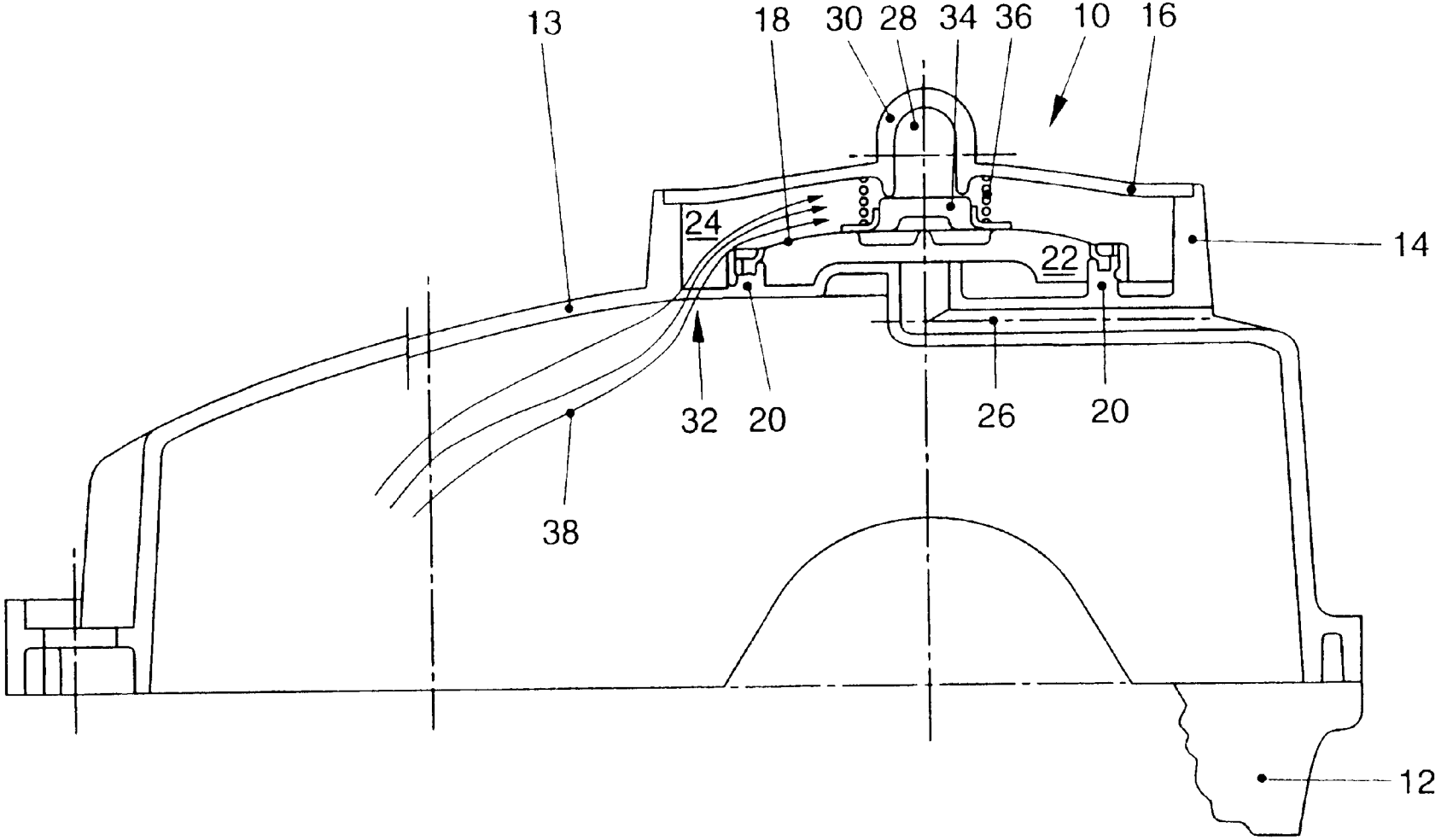
FIG. 1 shows a cross section of a valve pursuant to the present invention.
Figure 2:
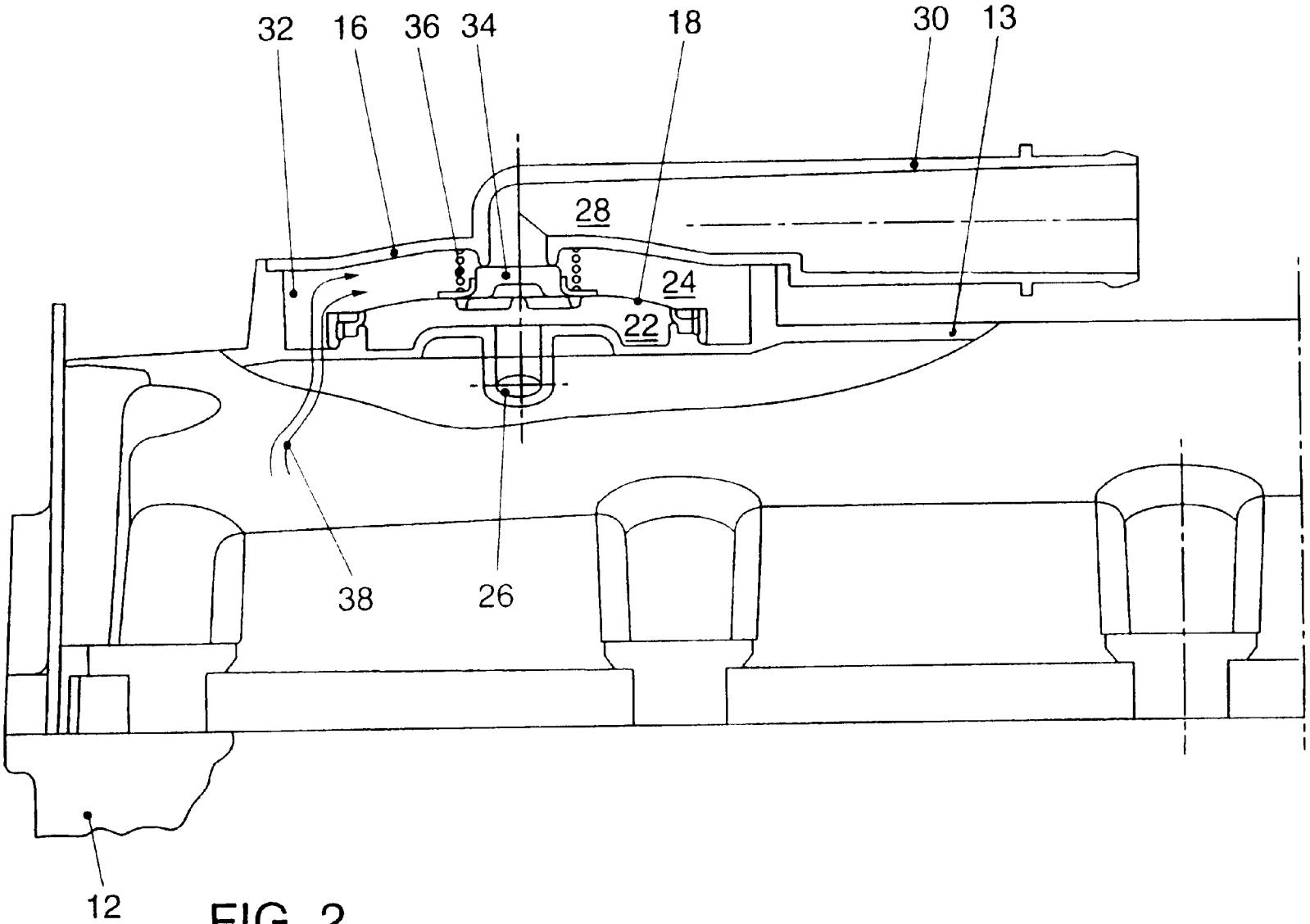
FIG. 2 shows a longitudinal section along line II—II in FIG. 1.

The preferred embodiment, illustrated in FIGS. 1 and 2, of a crankcase ventilation valve 10 according to the invention on a cowl 13 placed onto a crankcase 12 comprises a basic frame 14 and a cover 16 which together form a valve housing 14, 16. Arranged in the valve housing 14, 16 is a diaphragm 18 which is supported on a seat 20 and divides the valve housing 14, 16 into two chambers 22 and 24, specifically a lower chamber 22 and an upper chamber 24. The lower chamber 22 is arranged on the crankcase side, and the upper chamber 24 is formed opposite it on a side of the valve housing 14, 16 which faces away from the crankcase 12. Crankcase 12 means, here, the entity composed of a cylinder crankcase receiving the running mechanism and of a cylinder head placed on said cylinder crankcase.

The seat 20 of the diaphragm 18 and the basic frame 14 of the valve housing are designed integrally with the cowl 13. The cover 16 capable of being placed onto the basic frame 14 comprises, in addition, a gas outflow duct 28 with a connection piece 30 for connection to an air intake duct, not illustrated, of the internal combustion engine. The upper chamber 24 is thereby connected to the air intake duct of the internal combustion engine. Thus, the crankcase gases 38 passing via a gas inflow duct 32 into the upper chamber 24 are recirculated into the combustion process of the internal combustion engine and do not escape into the environment.

A ventilation valve disk 34 is arranged on the diaphragm 18 in such a way that, during a back-and-forth movement of the diaphragm 18, said disk 34 selectively opens or closes the gas outflow duct 28. For this purpose, the lower chamber 22 is connected to the environment on the crankcase side via a ventilation duct 26. Ambient pressure therefore always prevails in the lower chamber 22. Since the upper chamber 24 is connected to the air intake duct of the internal combustion engine, a pressure difference always prevails between the upper chamber 24 and the lower chamber 22, said pressure difference corresponding to the pressure difference between the air intake duct of the internal combustion engine and the environment. If there is a vacuum in the upper chamber 22, that is to say in the air intake duct, the diaphragm 18 is pressed upward in FIGS. 1 and 2, and the ventilation valve disk 34 closes the gas outflow duct 28. This automatically prevents the vacuum from being propagated to too great an extent into the crankcase 12 and, possibly, air from being sucked into the crankcase 12 through the crankshaft seal. On the other hand, it is desirable to have some vacuum at the crankcase ventilation valve 10, so that the crankcase gases 38 are correspondingly sucked away.

For this purpose, a spring 36 is provided, which is designed as a helical compression spring 36 and is arranged in the upper chamber 24. This spring 36 loads the diaphragm 18 in the opening direction of the ventilation valve disk 34, counter to ambient pressure, with a force such that the ventilation valve disk 34 closes the gas outflow duct 28 only when there is a pressure difference between the chambers 24 and 24, said pressure difference being predetermined by the spring stress. When the gas outflow duct 28 is open, the crankcase 12 is vented into the air intake duct of the internal combustion engine. In this case, as a result of the prestress of the spring 36, a maximum vacuum, up to which ventilation takes place, is set in the air intake duct of the internal combustion engine. When this vacuum or the pressure difference between the air intake duct and ambient pressure rises above a value predetermined by the spring 36, the external overpressure closes the gas outflow duct 28 via the diaphragm 18 and the ventilation valve disk 34.

Figure 3:
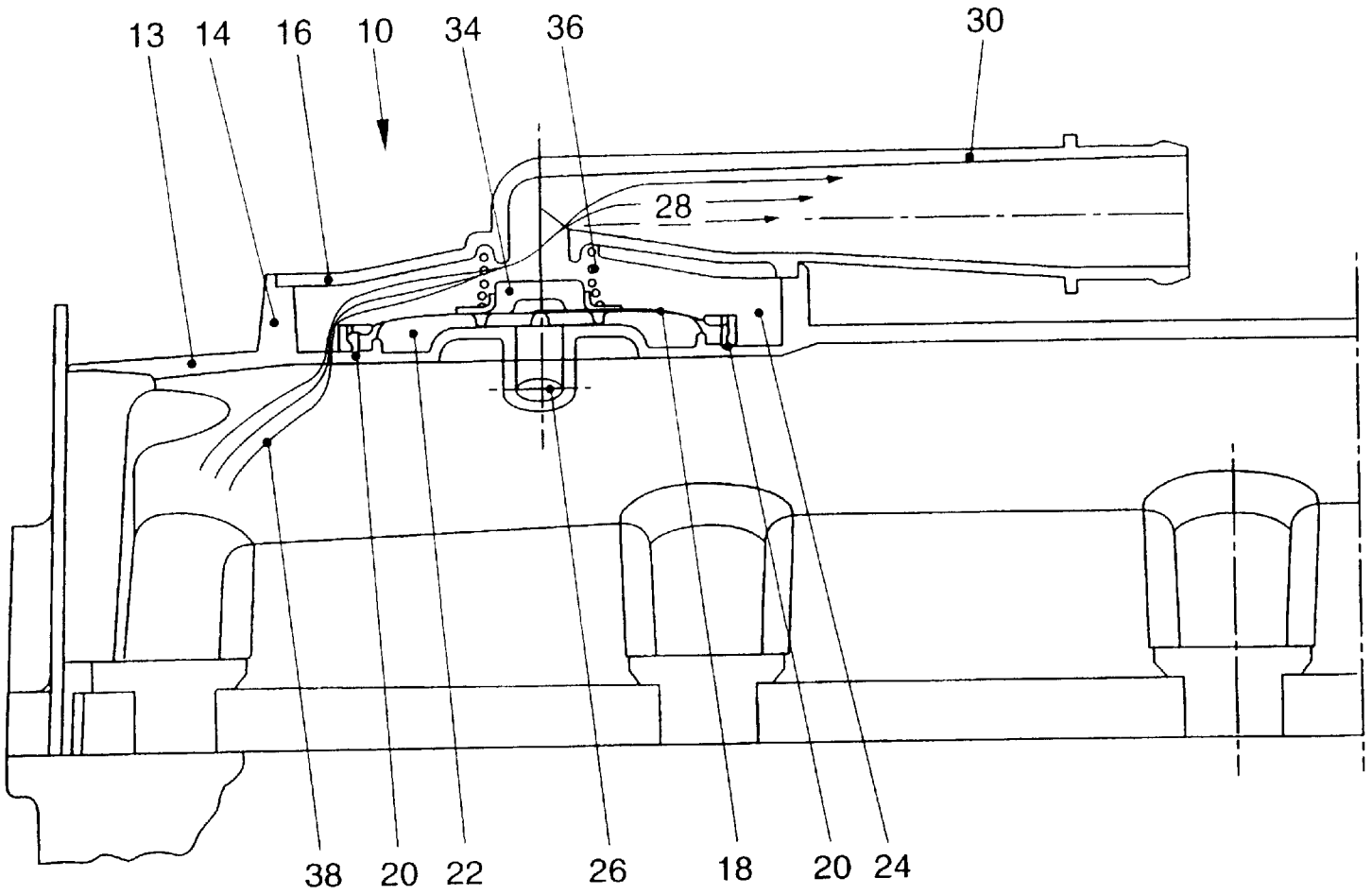
FIG. 3 shows a longitudinal section as is FIG. 2 with the ventilation valve open.

In the state illustrated in FIGS. 1 and 2, the gas outflow duct 28 is closed by the ventilation valve disk 34. By contrast, FIG. 3 shows the state when the gas outflow duct 28 is open. Here, the spring force is sufficiently high or the vacuum in the upper chamber 24 sufficiently low, and the crankcase gases 38 flow out of the crankcase 12 via the cowl 13 into the upper chamber 24 and, via the gas outflow duct 28 and the connection piece 30, into the air intake duct of the internal combustion engine, a slight vacuum in the air intake duct possibly assisting this process.

Figure 4:
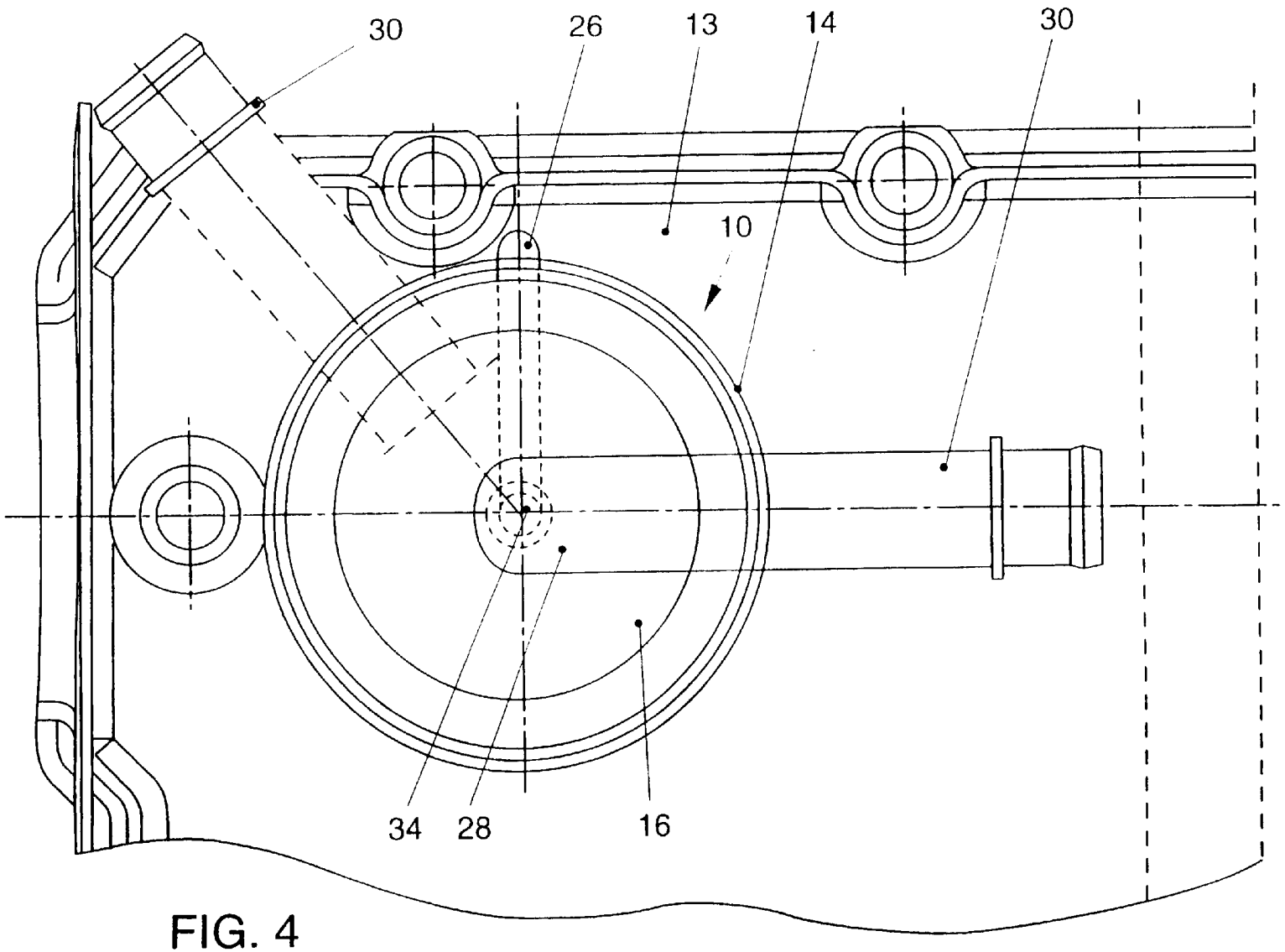
FIG. 4 shows a top view.

Depending on the installation position of the internal combustion engine, for example longitudinal or transverse installation, it may be necessary for the connection piece 30 to have to be oriented into an appropriately different direction for connection to the air intake duct of the internal combustion engine. For this purpose, the cover 16 is designed, on its circumference which comes into contact with the basic frame 14, so as to be rotationally symmetrical, and the basic frame 14 is of rotationally symmetric design. In this way, the cover 16 can be placed in any desired angular position onto the basic frame 14 and connected to the latter, so that the connection piece 30 can be oriented through any desired 360° angle around the cover 16. This is indicated in FIG. 4 for two angular orientations of the connection piece 30. The connection is made preferably by friction welding, but other solutions, for example adhesive bonding, screwing or ultrasonic welding, may also be envisaged.

A special feature of the crankcase ventilation valve 10 is that the atmospheric connection is made on a rear side of the diaphragm 18, that is to say from "inside" or on the crankcase side, via a duct 26 formed integrally, for example, in the cowl 13 of the crankcase 12.

Oil separation is carried out, for example, in a labyrinth, not illustrated, which is arranged upstream of the gas inflow duct 32 in the direction of flow and which is located in the cowl 13 or the crankcase 12. If oil, together with the crankcase gases 38, nevertheless enters the upper chamber 24, it can be separated in the chamber 24, for example on the side delimited by the cover 16, and can then flow out back into the crankcase 12 again via the gas inflow ducts 32.

The invention is not limited by the embodiments described above which are presented as examples only but can be modified in various ways within the scope of protection defined by the appended patent claims.

What is claimed is:

1. A crankcase ventilation valve for an internal combustion engine, comprising:

a valve housing;

a gas inflow duct connected to an interior of the crankcase;

a gas outflow duct connected to an air intake duct of the internal combustion engine;

a diaphragm arranged in the housing so as to divide the valve housing into a crankcase-side inner chamber and an outer chamber;

a ventilation valve disk, the diaphragm together with the ventilation valve disk being operatively arranged to selectively open and close the gas outflow duct depending on a pressure difference between the inner chamber and the outer chamber, the outer chamber of the valve housing being connected to the gas inflow duct; and a ventilation duct provided on the crankcase side so as to connect the inner crankcase-side chamber of the valve housing to ambient pressure.

2. A crankcase ventilation valve as defined in claim 1, wherein the valve housing is composed of two parts which include a basic frame open on one side and a cover connected to the basic frame and in which the gas outflow duct is integrated.

3. A crankcase ventilation valve as defined in claim 2, wherein the basic frame is rotationally symmetrical and the cover is rotationally symmetrical at least at a point of connection to the basic frame.

4. A crankcase ventilation valve as defined in claim 2, wherein the cover and the basic frame are connected to one another by friction welding.

5. A crankcase ventilation valve as defined in claim 2, wherein the basic frame is integral with the crankcase.

6. A crankcase ventilation valve as defined in claim 2, wherein the basic frame is integral with a cowl of the crankcase.

7. A crankcase ventilation valve as defined in claim 1, wherein the ventilation duct is formed integrally in the crankcase.

8. A crankcase ventilation valve as defined in claim 1, wherein the ventilation duct is formed integrally in a cowl of the crankcase.

9. A crankcase ventilation valve as defined in claim 1, and further comprising a spring arranged to prestress the diaphragm counter to the pressure in the crankcase-side inner chamber.

10. A crankcase ventilation valve as defined in claim 9 wherein the spring is a compression spring arranged in the outer chamber.

11. A crankcase ventilation valve as defined in claim 10, wherein the spring is a helical spring.

* * * * *